US008316813B2

(12) United States Patent
Prior

(10) Patent No.: US 8,316,813 B2
(45) Date of Patent: Nov. 27, 2012

(54) ENGINE ASSEMBLY HAVING VARIABLE INTAKE AIR TUNING DEVICE AND TUNING METHOD

(75) Inventor: Gregory P. Prior, Birmingham, MI (US)

(73) Assignee: GM Global Technology Operations LLC

( * ) Notice: Subject to any disclaimer, the term of this patent is extended or adjusted under 35 U.S.C. 154(b) by 825 days.

(21) Appl. No.: 12/398,433

(22) Filed: Mar. 5, 2009

(65) Prior Publication Data

US 2010/0224159 A1 Sep. 9, 2010

(51) Int. Cl.
*F02M 35/10* (2006.01)

(52) U.S. Cl. ..... 123/184.53; 181/241

(58) Field of Classification Search ..... 123/184.53–184.57, 184.21–184.61; 181/241, 249, 250, 251, 255, 264, 266, 269, 181/271, 273, 275–277

See application file for complete search history.

(56) References Cited

U.S. PATENT DOCUMENTS 3,141,519 A 7/1964 Bottum
3,253,676 A 5/1966 Bottum
3,920,095 A * 11/1975 Clark ..... 181/248
5,468,923 A 11/1995 Kleyn
5,787,852 A * 8/1998 Muramatsu et al. ..... 123/184.55
5,839,405 A * 11/1998 Falkowski et al. ..... 123/184.57
5,892,186 A 4/1999 Flugger
5,979,598 A * 11/1999 Wolf et al. ..... 181/272
6,732,510 B2 * 5/2004 Ciray ..... 60/312
6,752,240 B1 6/2004 Schlagenhaft
6,901,752 B2 * 6/2005 Uhler et al. ..... 60/312
2003/0085071 A1 5/2003 Boast et al.
2004/0118632 A1 * 6/2004 Ciray ..... 181/219
2005/0150718 A1 7/2005 Knight et al.
2005/0252716 A1 11/2005 Moenssen et al.
2008/0173271 A1 7/2008 Prior et al.

* cited by examiner

*Primary Examiner* — Noah Kamen
*Assistant Examiner* — Hung Q Nguyen
(74) *Attorney, Agent, or Firm* — Harness, Dickey & Pierce, P.L.C.

(57) ABSTRACT

An engine intake air tuning assembly may include a housing assembly and an air flow control member. The housing assembly may include an air inlet, an air outlet, and a body portion extending therebetween. The body portion may define an air flow passage and a tuning chamber. The air flow passage may provide fluid communication between the air inlet and outlet. The air flow control member may be located within the body portion and may be displaced between first and second positions relative to the air flow passage. The air flow control member may provide a first communication path from the air flow passage to the tuning chamber when in the first position and a second communication path from the air flow passage to the tuning chamber when in the second position. The second communication path may define a greater number of openings than the first communication path.

15 Claims, 8 Drawing Sheets

ENGINE ASSEMBLY HAVING VARIABLE INTAKE AIR TUNING DEVICE AND TUNING METHOD

FIELD

The present disclosure relates to engine air intake systems including noise attenuation devices.

BACKGROUND

This section provides background information related to the present disclosure which is not necessarily prior art.

Engine assemblies may include air intake systems providing communication between an air supply and an air intake port. During engine operation, noise may be generated at various frequencies based on engine operating conditions. A noise attenuation device may be located in the intake system to reduce this noise. These devices may include an air tuning volume separated into a series of discrete smaller volumes, each tuned to a specific frequency. Due to packaging constraints, the size of these discrete smaller volumes may be limited. Each of the smaller volumes may be in communication with the air intake flow by a separate fixed inlet to each of the discrete volumes. However, providing separate discrete volumes reduces the total available volume for a given frequency, reducing the effective noise attenuation of each of the targeted frequencies.

SUMMARY

This section provides a general summary of the disclosure, and is not comprehensive of its full scope or all of its features.

An engine intake air tuning assembly may include a housing assembly and an air flow control member. The housing assembly may include an air inlet in fluid communication with an air supply, an air outlet in fluid communication with an intake port of an engine, and a body portion extending therebetween. The body portion may define an air flow passage and a tuning chamber. The air flow passage may provide fluid communication between the air inlet and the air outlet. The air flow control member may be located within the body portion and may be displaced between first and second positions relative to the air flow passage. The air flow control member may provide a first communication path from the air flow passage to the tuning chamber when in the first position and a second communication path from the air flow passage to the tuning chamber when in the second position. The second communication path may define a greater number of openings than the first communication path.

A method of tuning an intake air flow in an engine may include providing a first communication path between an air intake flow of the engine and a tuning chamber during a first engine operating condition to attenuate a first air flow frequency. A second communication path may be provided between the intake air flow and the tuning chamber during a second engine operating condition to attenuate a second air flow frequency. The second air flow frequency may be higher than the first air flow frequency. The second communication path may include a greater number of openings than the first communication path.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
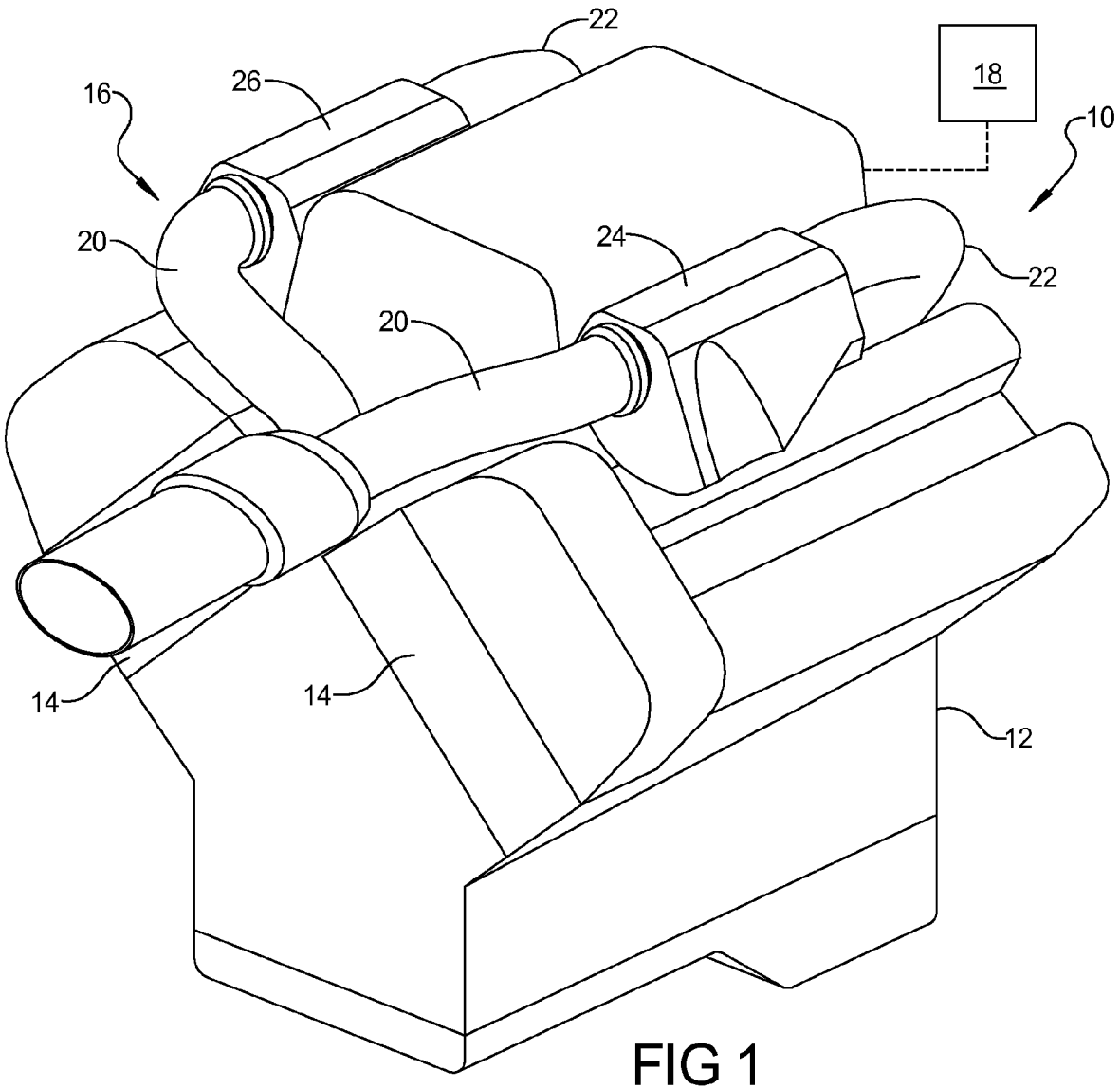
FIG. 1 is a perspective schematic illustration of an engine assembly according to the present disclosure.
Figure 2:
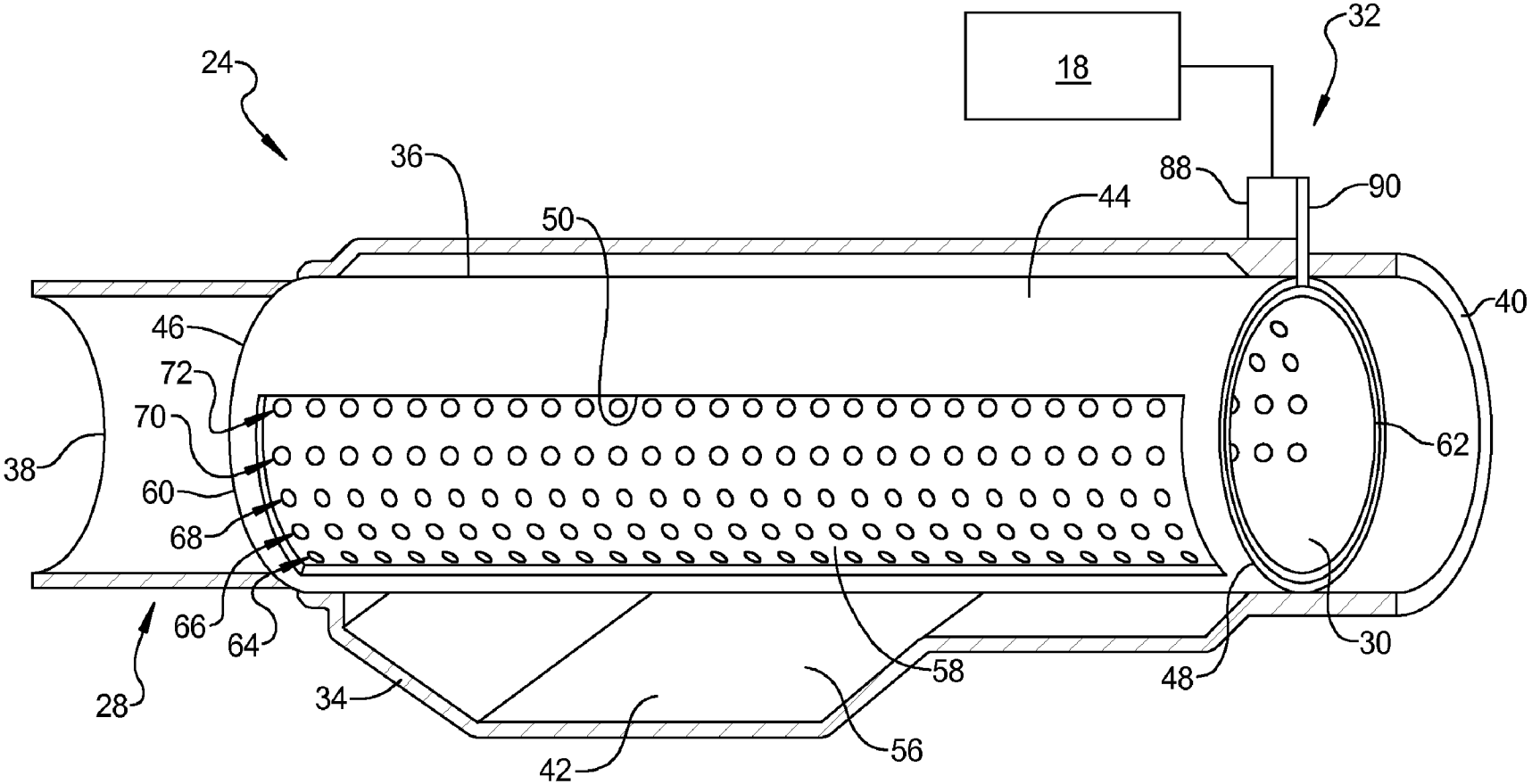
FIG. 2 is a section view of an intake air tuning assembly of the engine assembly of FIG. 1.
Figure 3:
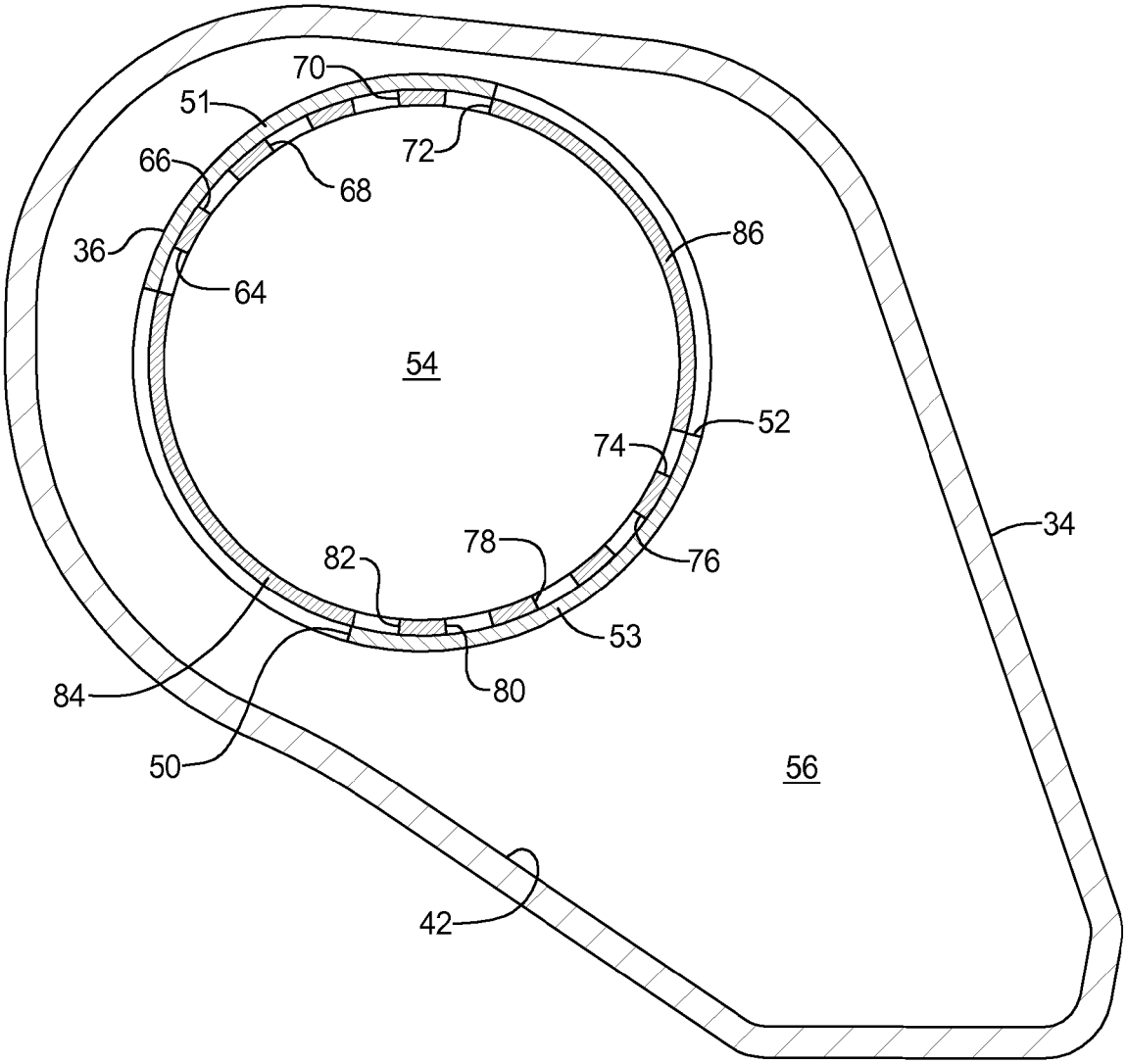
FIG. 3 is a section view of the intake air tuning assembly of FIG. 2 in a first position.

Referring now to FIG. 1, an exemplary engine assembly 10 is schematically illustrated. The engine assembly 10 may include an engine block 12, cylinder heads 14, an air intake system 16, and a control module 18. The engine block 12 may define cylinder bores (not shown) in communication with intake ports (not shown) in the cylinder heads 14. The air intake system 16 may include first conduits 20, second conduits 22, and first and second intake air tuning assemblies 24, 26.

The first conduits 20 may provide fluid communication between an air supply and the first and second intake air tuning assemblies 24, 26. The second conduits 22 may provide fluid communication between the first intake air tuning assembly 24 and a first intake port and between the second intake air tuning assembly 26 and a second intake port. The first and second intake air tuning assemblies 24, 26 may be generally similar to one another. Therefore, the first intake air tuning assembly 24 will be described in detail with the understanding that the description applies equally to the second intake air tuning assembly 26. Further, while illustrated in combination with a V-engine configuration, it is understood that the present teachings are not limited to V-engines and apply equally to a variety of other engine configurations including, but not limited to, inline engines.

With reference to FIGS. 2-8, the first intake air tuning assembly 24 may include a housing assembly 28, an air flow control member 30, and an actuation assembly 32. The housing assembly 28 may include a body portion having first and second members 34, 36. The first member 34 may include an inlet 38, an outlet 40, and a chamber 42 therebetween. The inlet 38 may be in fluid communication with the first conduit 20 and the outlet 40 may be in fluid communication with the second conduit 22. The second member 36 may include an axially extending body defining an annular wall 44 having an inlet 46 at a first axial end and an outlet 48 at a second axial end. The second member 36 may additionally include first and second openings 50, 52 extending radially through the annular wall 44 having first and second solid regions 51, 53 disposed circumferentially therebetween.

The second member 36 may extend between the inlet 38 and the outlet 40 and may cooperate with the inlet and outlet 38, 40 to define an air flow passage 54 through the housing assembly 28. The first and second members 34, 36 may additionally define an air tuning chamber 56 located radially outward from the air flow passage 54. By way of non-limiting example, the air tuning chamber 56 may extend around an outer circumference of the second member 36 to form an annular chamber. While described as including first and second members 34, 36, it is understood that the present disclosure is in no way limited to such a configuration and may include, by way of non-limiting example, a single piece body portion forming both the first and second members 34, 36.

The air flow control member 30 may include an axially extending body defining an annular wall 58 having an inlet 60 at a first axial end and an outlet 62 at a second axial end. The annular wall 58 of the air flow control member 30 may include a first circumferential extent having a first set of axial rows of openings 64, 66, 68, 70, 72 extending radially therethrough, a second circumferential extent having a second set of axial rows of openings 74, 76, 78, 80, 82 extending radially therethrough, and first and second solid regions 84, 86 located circumferentially between the first set of axial rows of openings 64, 66, 68, 70, 72 and the second set of axial rows of openings 74, 76, 78, 80, 82. The air flow control member 30 may be located radially between the air flow passage 54 and the air tuning chamber 56. In the present non-limiting example, the air flow control member 30 is illustrated slidably engaged with an inner radial surface of the second member 36 within air flow passage 54. However, it is understood that the air flow control member 30 may alternatively be slidably engaged with an outer radial surface (or outer circumference) of the second member 36 within the air tuning chamber 56.

By way of non-limiting example, the second member 36 and the air flow control member 30 may each have generally cylindrical bodies. The air flow control member 30 may form an annular sleeve rotatably disposed within the second member 36. The actuation assembly 32 may include an actuation mechanism 88 and an actuation member 90, such as a lever arm. The actuation member 90 may be rotationally fixed to the air flow control member 30 and may be engaged with the actuation mechanism 88 to selectively rotate the air flow control member 30 relative to the second member 36. The control module 18 may be in electrical communication with the actuation mechanism 88 as well as the engine assembly 10 to selectively rotate the air flow control member 30 based on engine operating conditions.

As seen in FIGS. 3-8, the air flow control member 30 may be rotated between a variety of positions by the actuation assembly 32. In a first position, shown in FIG. 3, the first solid region 84 may be aligned with and close the first opening 50 in the second member 36 and the second solid region 86 may be aligned with and close the second opening 52 in the second member 36, isolating the air flow passage 54 from fluid communication with the air tuning chamber 56. In the second through sixth positions, shown in FIGS. 4-8, various ones of the first set of axial rows of openings 64, 66, 68, 70, 72 are shown in fluid communication with the first opening 50 in the second member 36 and various ones of the second set of axial rows of openings 74, 76, 78, 80, 82 are shown in fluid communication with the second opening 52 in the second member 36, providing varying degrees of fluid communication between the air flow passage 54 and the air tuning chamber 56. However, in each of the first through sixth positions, the air tuning chamber 56 may be isolated from direct fluid communication with the inlet 38 and the outlet 40 of the first member 34.

Figure 4:
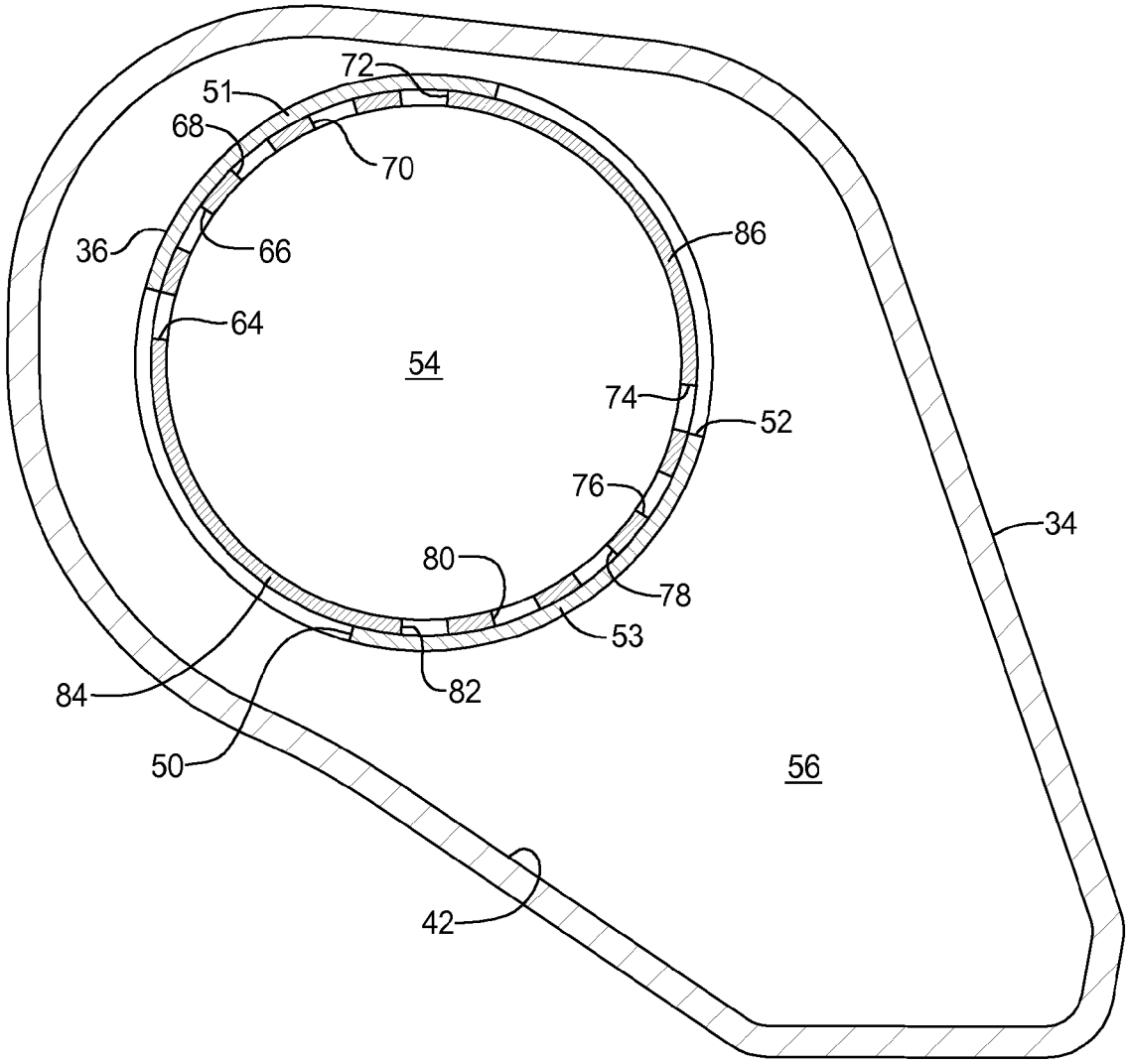
FIG. 4 is a section view of the intake air tuning assembly of FIG. 2 in a second position.

In the second position, shown in FIG. 4, a first row of openings 64 is aligned with the first opening 50 in the second member 36 and in fluid communication with the air tuning chamber 56 while the remainder of the first set of axial rows of openings 66, 68, 70, 72 are isolated from fluid communication with the air tuning chamber 56 by the first solid region 51 of the second member 36. A first row of openings 74 is aligned with the second opening 52 in the second member 36 and in fluid communication with the air tuning chamber 56 while the remainder of the second set of axial rows of openings 76, 78, 80, 82 are isolated from fluid communication with the air tuning chamber 56 by the second solid region 53 of the second member 36. The openings 64, 74 may form a fluid communication path between the air flow passage 54 and the air tuning chamber 56. More specifically, the openings 64, 74 may form the only communication path between the air flow passage 54 and the air tuning chamber 56 when the air flow control member 30 is in the second position.

Figure 5:
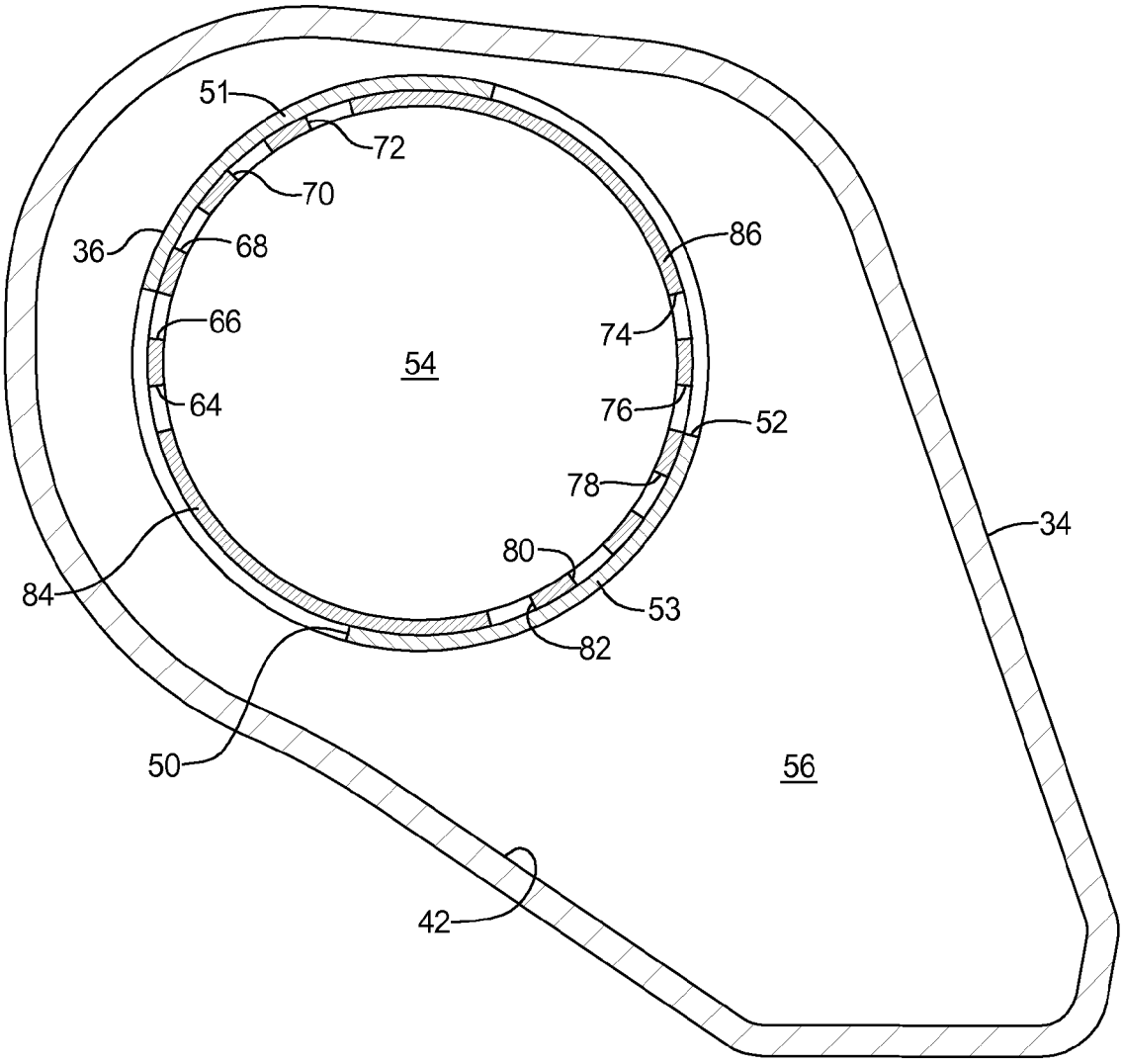
FIG. 5 is a section view of the intake air tuning assembly of FIG. 2 in a third position.

In the third position, shown in FIG. 5, first and second rows of openings 64, 66 are aligned with the first opening 50 in the second member 36 and in fluid communication with the air tuning chamber 56 while the remainder of the first set of axial rows of openings 68, 70, 72 are isolated from fluid communication with the air tuning chamber 56 by the first solid region 51 of the second member 36. First and second rows of openings 74, 76 are aligned with the second opening 52 in the second member 36 and in fluid communication with the air tuning chamber 56 while the remainder of the second set of axial rows of openings 78, 80, 82 are isolated from fluid communication with the air tuning chamber 56 by the second solid region 53 of the second member 36. The openings 64, 66, 74, 76 may form a fluid communication path between the air flow passage 54 and the air tuning chamber 56. More specifically, the openings 64, 66, 74, 76 may form the only communication path between the air flow passage 54 and the air tuning chamber 56 when the air flow control member 30 is in the third position.

Figure 6:
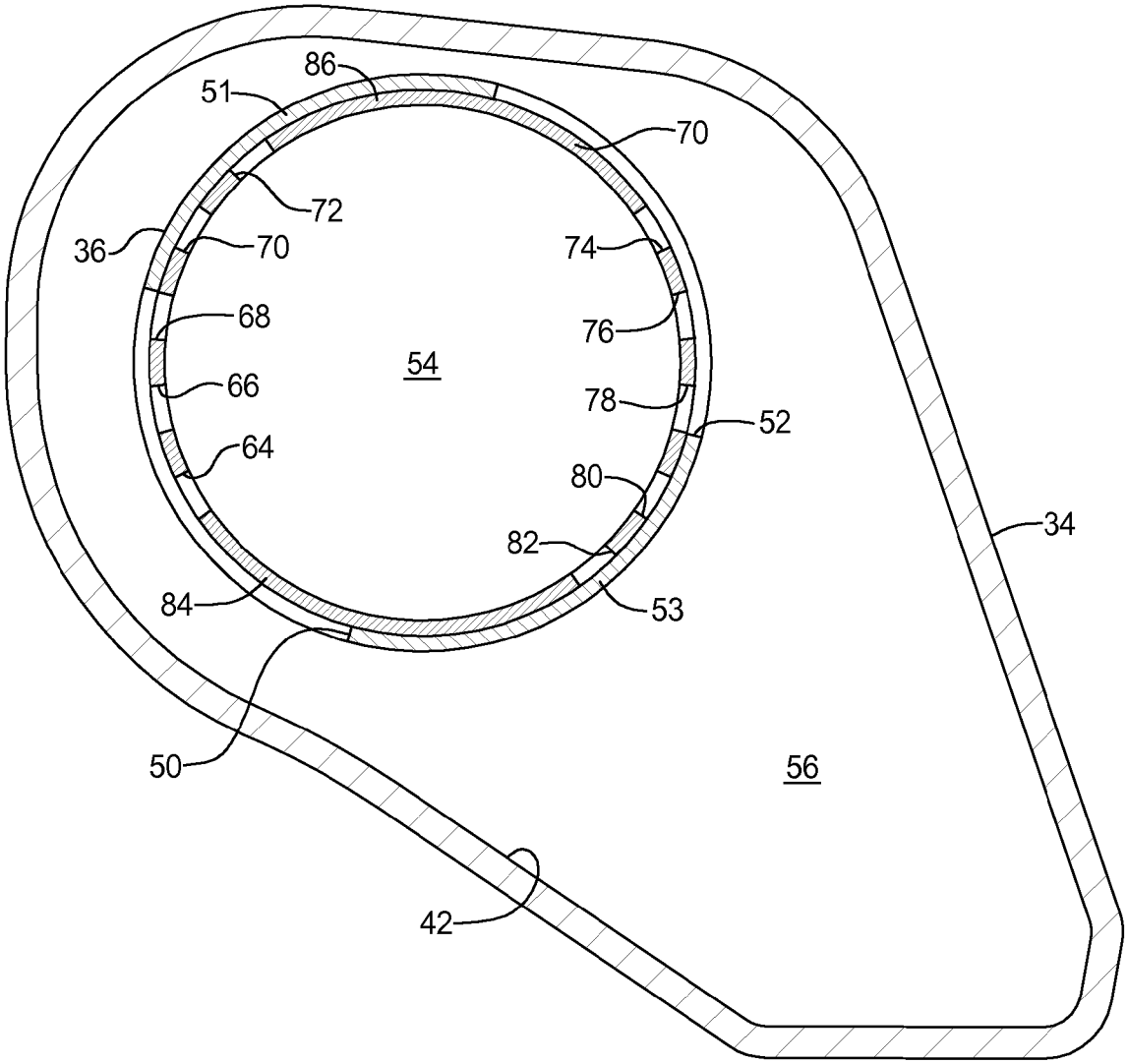
FIG. 6 is a section view of the intake air tuning assembly of FIG. 2 in a fourth position.

In the fourth position, shown in FIG. 6, first, second, and third rows of openings 64, 66, 68 are aligned with the first opening 50 in the second member 36 and in fluid communication with the air tuning chamber 56 while the remainder of the first set of axial rows of openings 70, 72 are isolated from fluid communication with the air tuning chamber 56 by the first solid region 51 of the second member 36. First, second, and third rows of openings 74, 76, 78 are aligned with the second opening 52 in the second member 36 and in fluid communication with the air tuning chamber 56 while the remainder of the second set of axial rows of openings 80, 82 are isolated from fluid communication with the air tuning chamber 56 by the second solid region 53 of the second member 36. The openings 64, 66, 68, 74, 76, 78 may form a fluid communication path between the air flow passage 54 and the air tuning chamber 56. More specifically, the openings 64, 66, 68, 74, 76, 78 may form the only communication path between the air flow passage 54 and the air tuning chamber 56 when the air flow control member 30 is in the fourth position.

Figure 7:
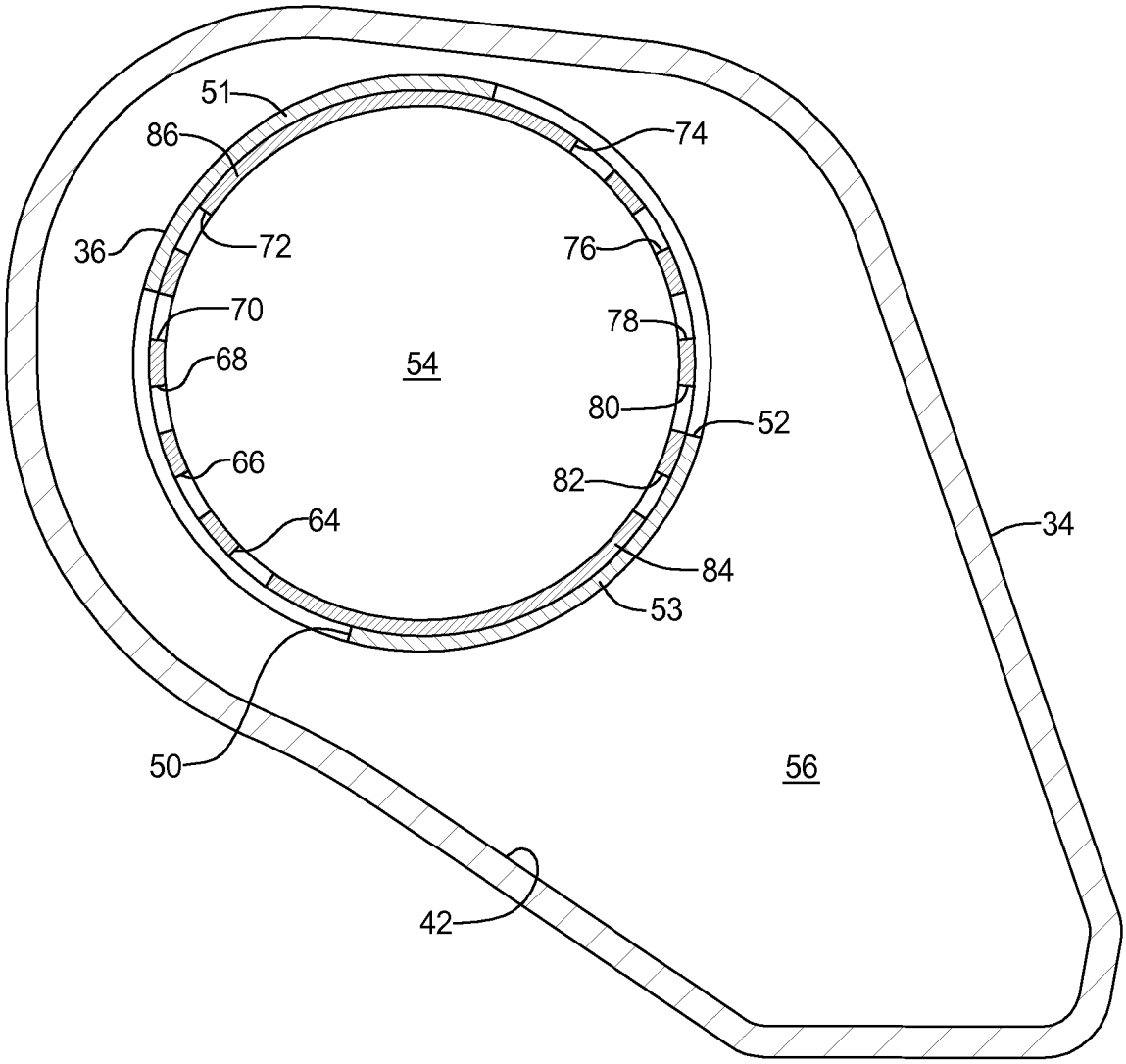
FIG. 7 is a section view of the intake air tuning assembly of FIG. 2 in a fifth position.

In the fifth position, shown in FIG. 7, first, second, third, and fourth rows of openings 64, 66, 68, 70 are aligned with the first opening 50 in the second member 36 and in fluid communication with the air tuning chamber 56 while the remaining row of openings 72 is isolated from fluid communication with the air tuning chamber 56 by the first solid region 51 of the second member 36. First, second, third, and fourth rows of openings 74, 76, 78, 80 are aligned with the second opening 52 in the second member 36 and in fluid communication with the air tuning chamber 56 while the remaining row of openings 82 is isolated from fluid communication with the air tuning chamber 56 by the second solid region 53 of the second member 36. The openings 64, 66, 68, 70, 74, 76, 78, 80 may form a fluid communication path between the air flow passage 54 and the air tuning chamber 56. More specifically, the openings 64, 66, 68, 70, 74, 76, 78, 80 may form the only communication path between the air flow passage 54 and the air tuning chamber 56 when the air flow control member 30 is in the fifth position.

Figure 8:
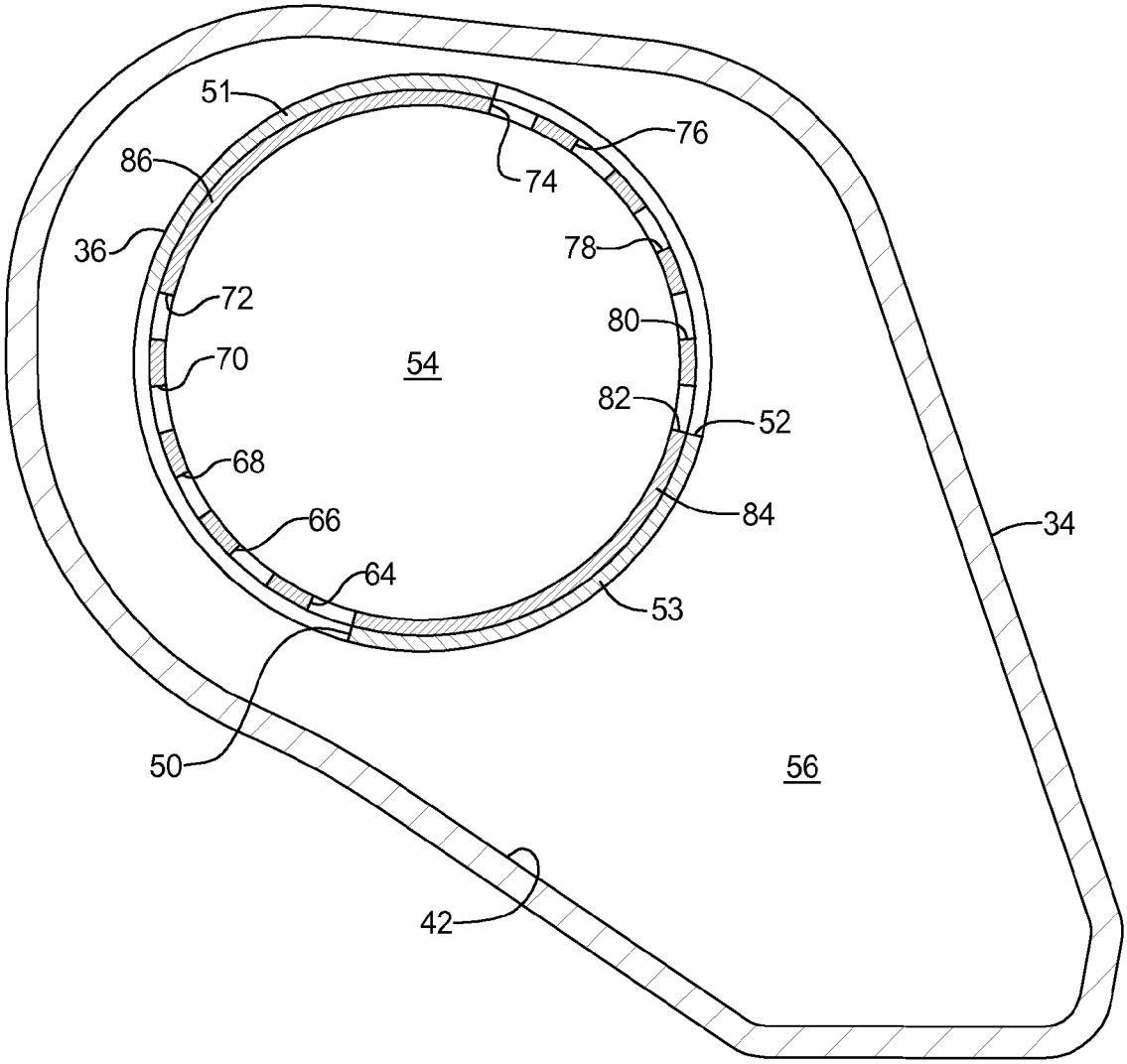
FIG. 8 is a section view of the intake air tuning assembly of FIG. 2 in a sixth position.

In the sixth and final position, shown in FIG. 8, each of the first set of axial rows of openings 64, 66, 68, 70, 72 are aligned with the first opening 50 in the second member 36 and in fluid communication with the air tuning chamber 56. Each of the second set of axial rows of openings 74, 76, 78, 80, 82 are aligned with the second opening 52 in the second member 36 and in fluid communication with the air tuning chamber 56. The openings 64, 66, 68, 70, 72, 74, 76, 78, 80, 82 may form a fluid communication path between the air flow passage 54 and the air tuning chamber 56. More specifically, the openings 64, 66, 68, 70, 72, 74, 76, 78, 80, 82 may form the only communication path between the air flow passage 54 and the air tuning chamber 56 when the air flow control member 30 is in the sixth position.

The first, second, third, fourth, fifth, and sixth positions of the air flow control member 30 may each correspond to a different frequency. The first position may correspond to a first and lowest tuning frequency. The sixth position may correspond to a sixth and highest tuning frequency. The second through fifth positions may correspond to second through fifth tuning frequencies. The second through fifth tuning frequencies may include intermediate frequencies between the first and sixth tuning frequencies and may increase from the second to the fifth frequency.

As illustrated in FIGS. 3-8, as the air flow control member 30 travels from the first to the sixth position, the communication path between the air flow passage 54 and the air tuning chamber 56 provided by the first and second sets of axial rows of openings 64, 66, 68, 70, 72, 74, 76, 78, 80, 82 increases. More specifically, the number of openings providing fluid communication between the air flow passage 54 and the air tuning chamber 56 increases. The increased number of openings may generally provide for the increased frequency attenuation. More specifically, the volume of the air tuning chamber 56 providing the frequency attenuation for each of the frequencies may remain constant while the communication path is modified. The volume of the air tuning chamber may be generally continuous and the volume used to attenuate the first frequency may be the same volume that is used to attenuate the second, third, fourth, fifth, and sixth frequencies.

During engine operation, the control module 18 may determine the operating engine speed. The operating frequency of the air intake system 16 may vary based on engine operating speed. By way of non-limiting example, during operation, the operating frequency of the air intake system 16 may generally increase with engine speed. The control module 18 may command displacement of the air flow control member 30 based on the engine speed. For example, the air flow control member 30 may advance from the first position to the second position as engine speed increases. The air flow control member 30 may be advanced further or returned to the first position thereafter based on an increase or decrease in engine speed.

What is claimed is:

1. An engine intake air tuning assembly comprising:

a housing assembly including an air inlet in fluid communication with an air supply, an air outlet in fluid communication with an intake port of an engine, and a body portion extending therebetween, the body portion defining an air flow passage and a tuning chamber, the air flow passage providing fluid communication between the air inlet and the air outlet; and an air flow control member located within the body portion and displaceable between first and second positions relative to the air flow passage, the air flow control member providing a first communication path from the air flow passage to the tuning chamber when in the first position and a second communication path from the air flow passage to the tuning chamber when in the second position, the second communication path defining a greater number of openings than the first communication path.

2. The intake air tuning assembly of claim 1, wherein the tuning chamber is isolated from direct fluid communication with the air inlet and the air outlet of the housing assembly when the air flow control member is in the first and second positions.

3. The intake air tuning assembly of claim 1, wherein the first communication path forms the only communication path between the air supply and the tuning chamber when the air flow control member is in the first position.

4. The intake air tuning assembly of claim 1, wherein the tuning chamber defines a volume located radially outward from the air flow passage.

5. The intake air tuning assembly of claim 4, wherein the air flow control member is located radially between the air flow passage and the tuning chamber.

6. The intake air tuning assembly of claim 5, wherein the air flow control member is rotatably disposed on a wall defining the air flow passage.

7. The intake air tuning assembly of claim 6, wherein the wall defining the air flow passage and the air flow control member cooperate to define a first opening forming a portion of the first communication path and providing fluid communication between the air flow passage and the tuning chamber when the air flow control member is in the first position.

8. The intake air tuning assembly of claim 7, wherein the wall defining the air flow passage and the air flow control member cooperate to define the first opening and a second opening, the first and second openings forming a portion of the second communication path and providing fluid communication between the air flow passage and the tuning chamber when the air flow control member is in the second position.

9. The intake air tuning assembly of claim 8, wherein the air flow control member is displaceable to a third position relative to the air flow passage, the first and second openings being closed and the tuning chamber being isolated from fluid communication with the air supply when the air flow control member is in the third position.

10. The intake air tuning assembly of claim 9, wherein the wall defining the air flow passage defines a tuning chamber opening, the first opening being in fluid communication with the tuning chamber via the tuning chamber opening when the air flow control member is in the first and second positions and the second opening being isolated from the tuning chamber opening when the air flow control member is in the first position.

11. The intake air tuning assembly of claim 6, wherein the air flow control member is rotatably disposed on an inner radial surface of the wall defining the air flow passage.

12. The intake air tuning assembly of claim 1, wherein the air flow control member is displaceable to a third position relative to the air flow passage, the tuning chamber being isolated from the air supply when the air flow control member is in the third position.

13. The intake air tuning assembly of claim 1, wherein the air flow control member includes an annular sleeve rotatably disposed on a wall defining the air flow passage.

14. The intake air tuning assembly of claim 1, wherein the tuning chamber defines a fixed tuning volume, the fixed tuning volume providing attenuation for a first frequency during engine operation when the air flow control member is in the first position and providing attenuation for a second frequency during engine operation when the air flow control member is in the second position, the second frequency being greater than the first frequency.

15. The intake air tuning assembly of claim 1, further comprising an actuation mechanism coupled to the air flow control member to provide the relative displacement between the air flow control member and the air flow passage.

* * * * *